US005364162A

United States Patent [19]

Bar et al.

[11] Patent Number: 5,364,162

[45] Date of Patent: Nov. 15, 1994

[54] BACKREST ASSEMBLY FOR A WHEELCHAIR

[75] Inventors: Christopher Bar, Roath, Great Britain; Calvin L. Guthrie, Belleville, Ill.

[73] Assignee: Roho, Inc., Belleville, Ill.

[21] Appl. No.: 663,098

[22] Filed: Mar. 1, 1991

[51] Int. Cl.[5] ..... A47C 7/00

[52] U.S. Cl. ..... 297/284.8; 297/284.7; 297/440.2; 297/DIG. 4

[58] Field of Search ..... 297/444, 284, 355, 358, 297/374, 230, 231, 383, 354, DIG. 4, 284.8, 440.2, 284.7

[56] References Cited

U.S. PATENT DOCUMENTS

| | | | |
|---|---|---|---|
| 3,203,732 | 8/1965 | Hoffman | 297/444 |
| 4,898,425 | 2/1990 | Mundy | 297/444 |
| 5,067,677 | 11/1991 | Jay et al. | 297/444 |

FOREIGN PATENT DOCUMENTS

| | | | |
|---|---|---|---|
| 320732 | 5/1932 | United Kingdom | 297/444 |

*Primary Examiner*—Kenneth J. Dorner
*Assistant Examiner*—Cassandra Davis
*Attorney, Agent, or Firm*—Polster, Leider, Woodruff & Lucchesi

[57] ABSTRACT

A contoured backrest for a wheelchair may be moved to and retained in different positions and thus accommodates individuals of varying size and disabilities. The backrest carries clamps to which outriggers are fitted, and these outriggers extend transversely across the back face of the backrest. The outriggers are laterally adjustable to accommodate wheelchairs of different widths. They have offset ends beyond the sides of the backrest, and these ends fit into brackets on back posts that are part of the wheelchair. When the clamps are released, the outriggers may be rotated. This enables the position of the backrest to be adjusted forwardly and backwardly, upwardly and downwardly, and angularly.

28 Claims, 3 Drawing Sheets

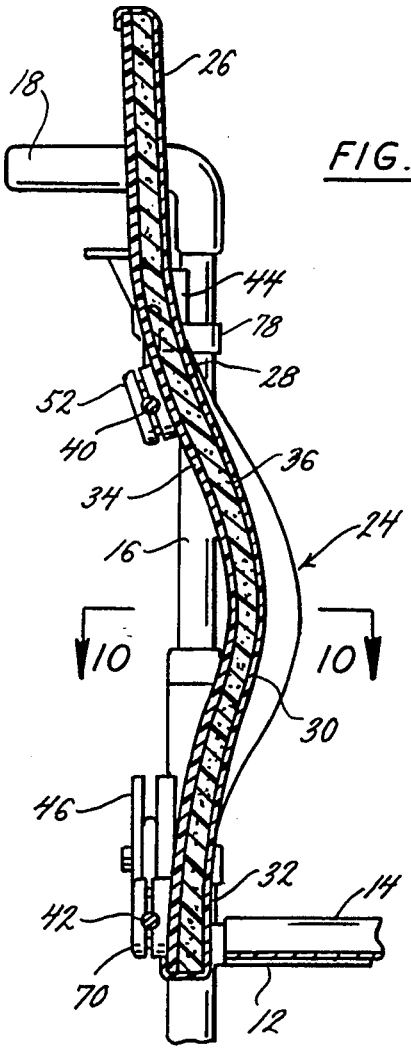
FIG. 3.
FIG. 4.
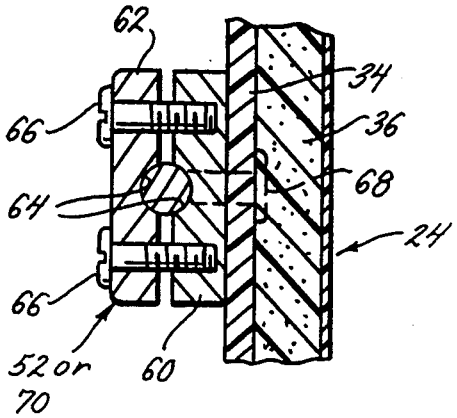
FIG. 5.
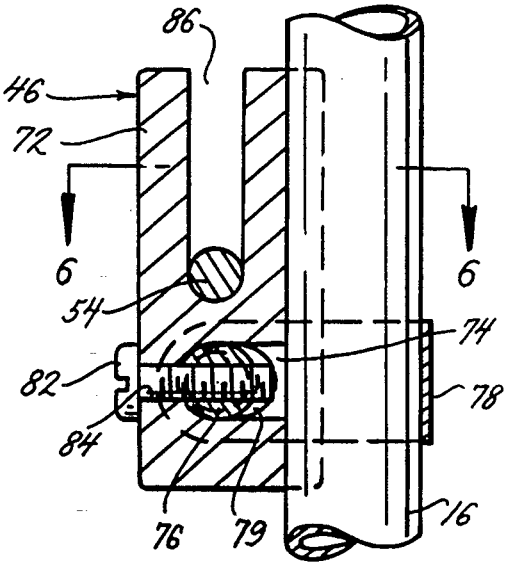
FIG. 10.
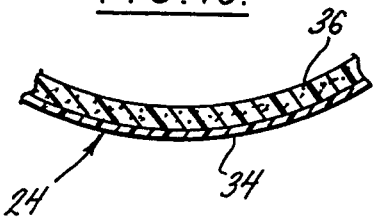
FIG. 6.
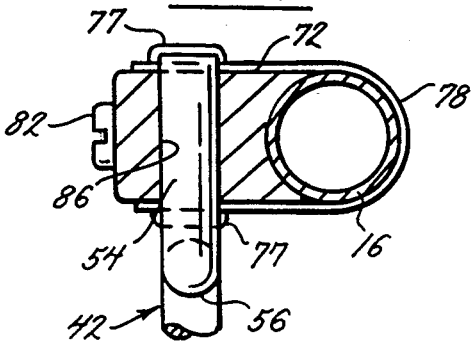

FIG. 2.
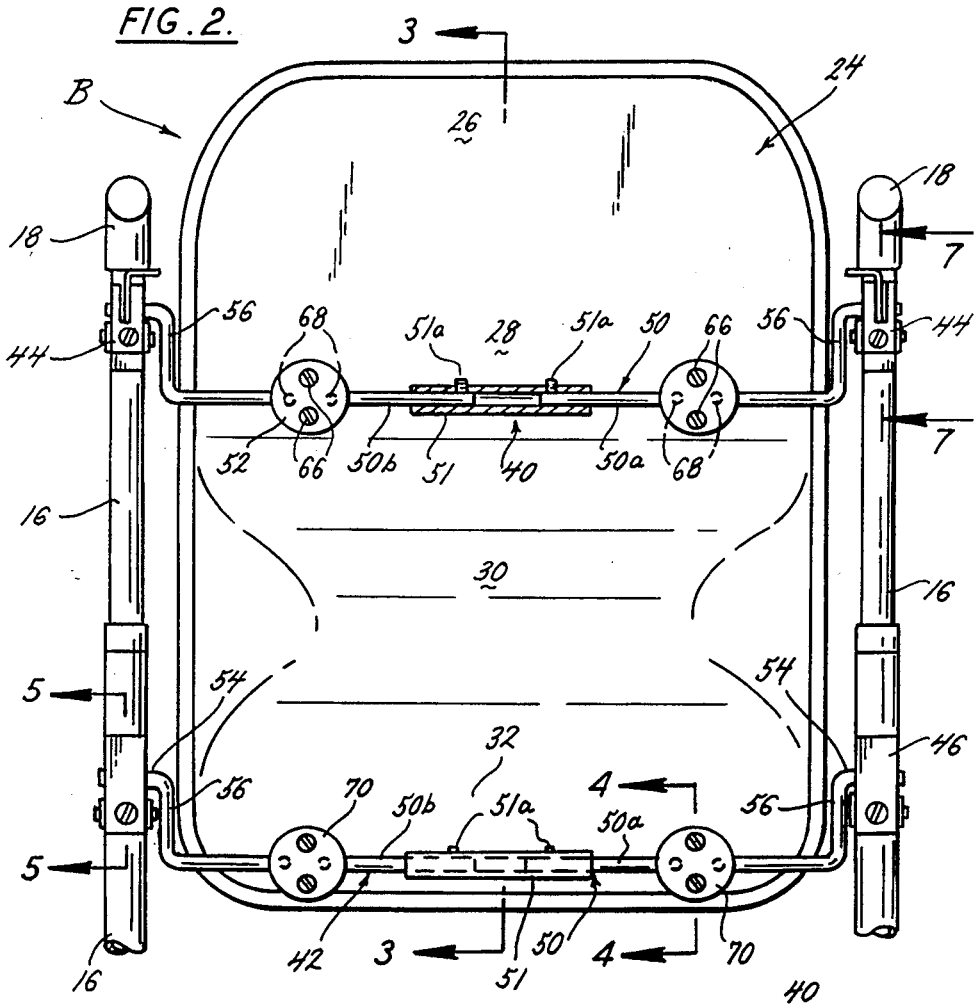
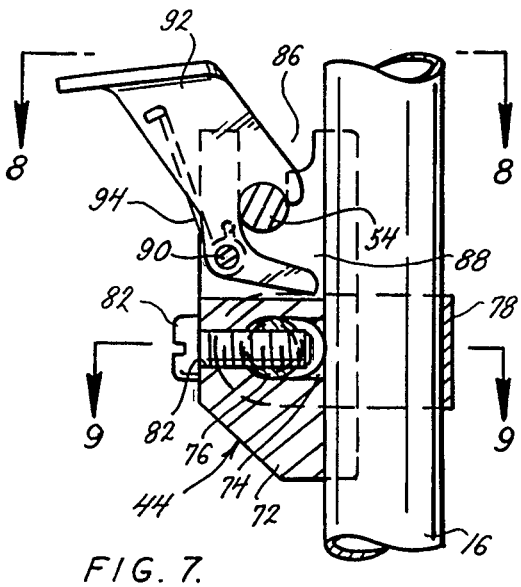
FIG. 7.
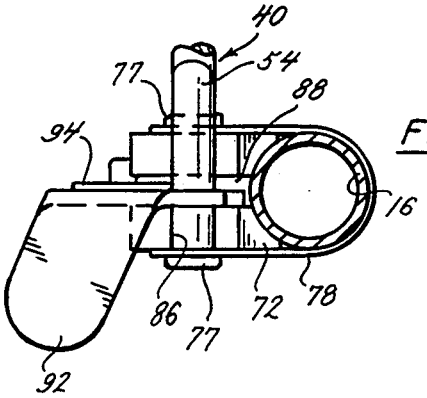
FIG. 8.
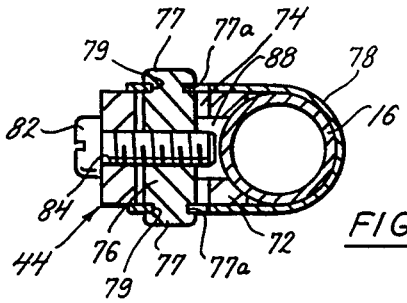
FIG. 9.

BACKREST ASSEMBLY FOR A WHEELCHAIR

BACKGROUND OF THE INVENTION

This invention relates in general to seating and, more particularly, to a backrest assembly for wheelchairs.

The typical wheelchair has a pair of side frames to which the wheels of the chair are attached and struts interposed between the frames for maintaining them apart and generally parallel. The struts for most wheelchairs collapse to enable the side frames to move together, thus allowing the wheelchair to assume a more compact configuration for storage or transport. Usually, the seat and backrest are nothing more than flexible slings that extend between the two frames. While the slings fold with the chair as it assumes its compact configuration, they fail to provide a truly optimum seating surface or back surface. Much of the problem resides in the seat, and special seat cushions are available to improve seating posture and reduce the incidence of pressure sores. Some individuals, particularly those whose muscles have atrophied or those who have spinal deformities, need better support than a traditional sling-type backrest can provide.

Special contoured backs exist, but to a large measure they are custom made to accommodate the problems peculiar to individual users, and thus are very expensive. More universal backrests of a rigid character also exist, but they are difficult to adjust to accommodate the needs of individual users, do not accommodate different width chairs, and furthermore are not easily removed from chairs to enable such chairs to fold to their compact configurations.

The present invention resides in a backrest assembly for enhancing the posture and comfort of those confined to wheelchairs. Aside from a contoured backrest, it includes outriggers and brackets for supporting the backrest on the backposts that rise upwardly from the side frames of a wheelchair. The brackets and outriggers are such that the backrest may be moved to a multitude of positions—and in that sense the backrest is suited for use by a wide variety of individuals. The backrest outriggers also are adjustable in width to accommodate chairs of different widths and to reduce the number of different sizes that must be kept in inventory. Moreover, the backrest is easily removed from the wheelchair, so that the wheelchair may be folded to a compact configuration.

These and other objects and advantages will become apparent hereinafter.

DESCRIPTION OF THE DRAWINGS

In the accompanying drawings which form part of the specification and wherein like numerals and letters refer to like parts wherever they occur.

FIG. 2 is a rear elevational view of the backrest assembly attached to the backpost of a wheelchair;

FIG. 3 is a sectional view of the backrest assembly taken along line 3—3 of FIG. 2;

FIG. 4 is a sectional view of one of the outrigger clamps taken along line 4—4 of FIG. 2;

FIG. 5 is a sectional view of one of the lower outrigger brackets taken along line 5—5 of FIG. 2;

FIG. 6 is a sectional view of the lower outrigger bracket taken along line 6—6 of FIG. 5;

FIG. 7 is a sectional view of one of the upper brackets taken along line 7—7 of FIG. 2;

FIG. 8 is a top plan view of the upper outrigger bracket taken along line 8—8 of FIG. 7;

FIG. 9 is a sectional view of the upper outrigger bracket taken along line 9—9 of FIG. 7, and;

FIG. 10 is a sectional view taken along line 10—10 of FIG. 3 and showing the backrest forming part of the backrest assembly.

DETAILED DESCRIPTION

Figure 1:
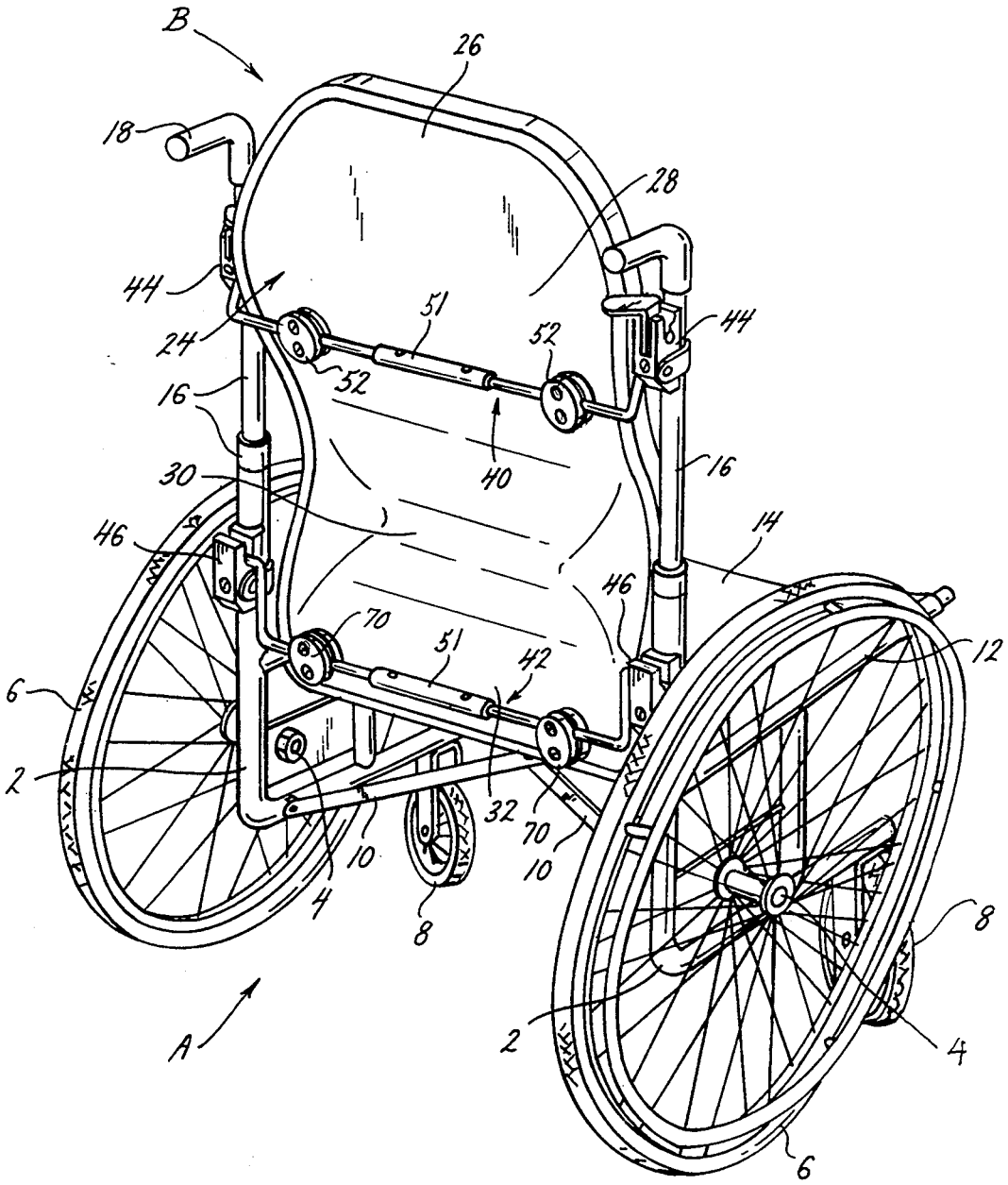
FIG. 1 is a perspective view of a wheelchair provided with a backrest assembly constructed in accordance with and embodying the present invention.

Referring now to the drawings, a wheelchair A (FIG. 1) includes two side frames 2, each having a spindle 4 on which a large wheel 6 rotates. Fitted to the front of each side frame 2 is a smaller caster-type wheel 8. The two frames 2 are maintained generally parallel and a fixed distance apart by struts 10 which fold so that the side frames 2 will move together. This enables the wheelchair A to assume a more compact configuration suitable for storage or transport. Each side frame 2 has a horizontal member 12, and the horizontal members 12 of the two side frames 2 support a seat 14 which extends between them. Each side frame 2 at its rear also has back post 16 which rises well above the horizontal member 12 and the wheel for the frame 2, and at its upper end turns rearwardly in the form of a handle 18. The back posts 16 of the two side frames 2 carry a backrest assembly B which, generally speaking, occupies the space between the two posts 16 where it extends well above the seat 14 and indeed up to and beyond the handles 18. Whereas, the seat 14 carries most of the user's weight, the backrest assembly B to measure supports the user's back and certainly positions the back. The side frames 2, wheels 6 and 8, struts 10 and seat 14 are conventional. The invention resides in the backrest assembly B.

The backrest assembly B (FIGS. 2 and 3) includes a contoured backrest 24 having a top section 26 portion which is generally flat, a slightly concave upper back region 28 which is immediately below the top section 26, a forwardly bowed lumbar region 30 immediately below the concave region 28, and a generally flat lower end section 32 below the lumbar region 30. The upper margin of the top section 26 extends horizontally at the center of the top section 26 and then curves downwardly and merges with the side margins which lie along upper back region and lumbar region and as such are set inwardly from the back posts 16 of the two side frames 2. At the bottom section 32 the side margins merge into a horizontal bottom margin which occupies most of the width of the bottom section 32 and is thus longer than horizontal portion of the top section 26. Whereas the top section 26 and bottom section 32 are to a large measure flat, the upper back region 28 is slightly concave from side to side on its front surface. The lumbar region 30, while bowing forwardly and thus being convex on its forward surface is also concave from side to side (FIG. 10), so that side margins of the backrest 24 along the lumbar region project farther forwardly then the midsection of the lumbar region 30.

The backrest 24 has a rigid backing plate 34 (FIG. 3) and a cushion 36 attached to backing plate 34. The backing plate may be formed from a sheet of generally rigid polymer such as ABS plastic. The cushion 36, on the other hand, may be a simple foam located over the forwardly presented face of the backing plate 34 or it may be a cellular cushion of the type manufactured and sold by ROHO, Inc., of Belleville, Ill.

In addition to the backrest 24, the backrest assembly B includes upper and lower outriggers 40 and 42 (FIG. 2) which are adjustable in width (as will be explained hereinafter) and which extend transversely across the backrest 24, to which they are attached, and upper and lower brackets 44 and 46 which are mounted on the back posts 16 for the side frames 2 of the wheelchair A and engage the ends of the outriggers 40 and 42 to support the backrest 24 between the two back posts 16. The location of the ends of the outriggers 40 and 42 with respect the backrest 24 may be altered and likewise the location of the brackets 44 and 46 along the backposts 16 may be changed. These adjustments permit the backrest 24 to assume a multitude of positions with respect to the seat 14, and thus the backrest 24 can meet the requirements of many different users and many different types of chairs. In short, the outriggers 40 and 42 serve as positioning members which control the vertical, horizontal and angular positions of the backrest 24.

The upper outrigger 40 has a cross rod 50 divided into two sections 50*a* and 50*b* (FIG. 2) which extends transversely across the backrest 24 behind its upper back region 28. The two sections 50*a* and 50*b* are connected by a sleeve 51 and secured to the sleeve 51 by set screws 51*a*. This connection allows the cross rod 50 to be adjusted in length to accommodate wheel chairs of different widths. The cross rod 50 passes through two clamps 52 which are attached to the backing plate 34 of the backrest 24, and normally hold the outrigger 40 rigid with respect to the backrest 24. However, the clamps 52 may be released to relax their grips on the cross rod 50, and when released, the outrigger 40 will rotate relative to the backrest 24 and the upper brackets 44 as well. This permits the backrest 24 to move relative to posts 16 and seat 14, in that the upper cross rods 50 engage the upper brackets 44 at ends 54 which are offset radially from the cross rod 50. More specifically, the cross rod 50 extends slightly beyond the side margins of the backrest 24, and here the rod 50 turns radially in the form of positioning arms 56 which extend out to the offset ends 54. The two arms 56 extend in the same direction from the cross rod 50 and indeed are parallel. The ends 54, which derive from the arms 56 being turned outwardly, lie parallel to the cross rod 50 and in axial alignment, that is they are the same distance from the cross rod 50. If the width adjustment feature is not desired, the entire outrigger 40 may be formed from a single length of rod stock.

Each clamp 52 includes (FIG. 4) an inside disk 60 and outside disk 62 which have opposed horizontal grooves 64 through which the cross rod 50 of the upper outrigger 40 extends. In depth, the grooves 64 are less than the radius of the cross rod 50, so that when the two disks 60 and 62 are clamped together, the cross rod 50 is captured tightly between the two and will not turn. The clamping is provided by two screws 66 which pass through the outer disk 62 and thread into the inner disk 60, one above the grooves 64 and the other below. When rotated inwardly, the screws 66 urge the outer disk 62 toward the inner disk 60 and thus prevent the outrigger 40 from rotating between the two disks 60 and 62. The inner disk 60 is attached to the backing plate 34 of the backrest 24 at the upper back region 28 of the plate 34, preferably by screws 68 which pass through the backing plate 34 and thread into the inner disk 60.

The lower outrigger 42 is essentially the same as the upper outrigger 40 and as such has a cross rod 50 composed of sections 50*a* and 50*b*, offset ends 54 and connecting arms 56 located between the ends of the cross rod 50 and the offset ends 54 (FIG. 2). The two sections 50*a* and 50*b* are connected by a sleeve 51 and secured to the sleeve 51 by set screws 51*a*. This connection allows the cross rod 50 to be adjusted in length to accommodate wheel chairs of different widths. The cross rod 50 of the outrigger 42 extends horizontally behind the flat bottom section 32 of the backrest 24 and here the cross rod 50 is attached to the backing plate 34 of the backrest 24 at two lower clamps 70 which are identical to the upper clamps 52. As such, each has inner and outer disks 60 and 62 provided with grooves 64 and screws 66 which urge the disks 40 and 42 together. The offset ends 54 of the lower outrigger 42 fit into the lower brackets 46.

Each lower bracket 46 includes (FIGS. 5 and 6) a block 72 having a concave forward face which matches the curvature of the back post 16 against which it fits. The block 72 near its lower end contains a short slot 74 that extends from side to side in the block 72 with its elongation perpendicular to the axis of the post 16. The slot 74 in turn contains a cross bar 76 which fits somewhat loosely so that it can move toward and away from the post 16. The cross bar 76 is slightly longer than the block 72 is wide, and has end caps 77 connected to its ends. The cross bar 76 carries a strap 78 which passes around the front of the post 16. At its ends, the strap 78 is provided with openings 79 which are slightly larger than end caps 77. The end caps 77 fit through the openings 79 to connect the strap 78 to the cross bar 76. When the bar 76 is at the front of its slot 74, the strap 78 fits rather loosely around the post 16 and the bracket 46 may move upwardly and downwardly on the post 16. However, the location of the cross bar 76 is under the control of a headed machine screw 82 which extends loosely through an opening 84 in the block 72 from its back face. Beyond the opening 84 the screw 82 threads into the cross bar 76 midway between the ends of the cross bar 76. When the head of the screw 82 is turned down against the back face of the block 72, the cross bar 76 moves rearwardly and draws the strap 78 tightly around the post 16. This secures the block 72 firmly against the post 16. In addition, the block 72 contains a vertical slot 86 which extends transversely and opens out of the upper end of the block 72. The slot 86 is large enough to accommodate one of the offset ends 54 of the lower outrigger 42 somewhat loosely and indeed receives that offset end 54. Thus, the lower brackets 46, by confining the offset ends 54 of the lower outrigger 42 in the vertical slots 86, serve to position lower end of the backrest 24, at least when the lower clamps 70 tightly grip the cross rod 50 of the outrigger 42 and prevents that rod from turning.

The upper brackets 44 are somewhat similar to the lower brackets 46 (FIGS. 7–9). In this regard, each has a block 72 provided with a concave front surface that fits against the surface of one of the back posts 16. Each, near its lower end, also has a short slot 74 containing a crossbar 76 which serves to anchor the ends of a strap 78 that passes around the post 16, the strap having openings 79 slightly larger than the cross bar end caps 77. The end caps 77 are connected to the ends of the cross bar 76 by reduced portions 77*a*. A machine screw 82 extends loosely through an opening 84 in the block 72 from its back face. The screw 82, midway between the sides of the block 72, threads into the crossbar 76. Thus, when the head of the screw 82 is turned downwardly against the back face of the block 72, the cross bar 78 is drawn rearwardly until the strap 78 tightly grips the post 16. In addition, the block 72 contains a vertical slot 86, which extends transversely and opens upwardly, and is furthermore large enough to receive one of the offset ends 54 on the upper outrigger rod 40. However, the slot 86 in the upper bracket 44 is shorter than the vertical slot 86 in the lower bracket 46 and furthermore is somewhat wider at its open top. Aside from that, the block 72 of the upper bracket 44 has another vertical slot 88 located midway between its sides, and this slot intersects the transverse slot 86. Between the bottom of the transverse slot 86 and the short slot 74 in which the cross bar 76 is contained, the block 72 of the upper bracket 44 contains a pivot pin 90 about which a latch 92 rotates between a locking or closed position and a release position. Urging the latch 92 to its closed position is a spring 94 which wraps around the pivot pin 90 and is to a large measure contained within the slot 88.

When the latch 92 is in its closed position (FIG. 7), it blocks the upper end of the vertical slot 86, indeed, with an arcuate surface that conforms to the curvature of the offset end 54 of the upper outrigger 40. Enough space exists between the arcuate surface and the bottom of the slot 86 to accommodate the offset end 54, even as the latch 92 is moved to its release position. Of course, when the latch 92 is in its release position, it no longer blocks the vertical slot 86 and the offset end 54 may be lifted upwardly out of the slot 86. Indeed, as the latch 92 approaches its release position, another portion of the latch 92 enters the bottom of the slot 86 and actually pushes the offset end 54 of the upper outrigger 40 upwardly.

The clamps 52 and 70, the outriggers 40 and 42 and the brackets 44 and 46 enable the backrest 24 to assume a multitude of positions, and by reason of the adjustment afforded by the clamps 52 and 70 and the brackets 44 and 46, a therapist should be able to position the backrest 24 to fit users of different sizes as well as users having different skeletal deformities. By releasing the upper clamps 52, which is achieved simply by backing off the set screws 66, one can rotate the upper outrigger 40. Since the offset ends 54 of the outrigger 40 are confined to a fixed axis by the upper brackets 44, the rotation of the upper outrigger 40 moves the upper end of the backrest 24 forwardly and rearwardly as well as vertically. In effect, the cross rod 50 of the upper outrigger 40 serves as the end of a crank arm and the connected portion of the back rest 24 merely follows it.

The lower brackets 46, while confining the offset ends 54 of the lower outriggers 42 horizontally, do not restrict it vertically, and hence the lower end of the backrest 24 is free to move to accommodate the vertical motion and rotation imparted to the upper outrigger 40. If the rotation elevates or depresses the upper end of the backrest 24 too much, the upper brackets 46 may be repositioned along the posts 16 by backing off the screws 82 that control their straps 78 and moving them to a new location.

On the other hand, the location of the lower end of the backrest 24 is under the control of the lower outrigger 42, and it too, when turned, functions like a crank arm. However, its offset ends 54, not being confined vertically by the lower brackets 46, are free to rise and fall in the vertical slots 84 of those brackets. Hence, rotation of the lower outrigger 42 moves the lower end of the backrest 24 either forwardly or rearwardly. Should the adjustments provided by rotational of either one of the outriggers 40 or 42 move or elevate the offset ends 54 of the lower outrigger 42 above the lower brackets 46, those brackets may be raised to again recapture the offset ends 54 of the lower outrigger 42, simply by loosening the screws 82 and moving the brackets 46 upwardly to the desired location, whereupon the screws 82 are again tightened. The same holds true if the rotation of either outrigger 40 or 42 crams the offset ends 54 of the lower outriggers 42 into the bottoms of the slots 86 for the lower brackets 46.

The backrest 24 does not detract from the capacity of the wheelchair A to fold into a highly compact configuration. Should one desire to collapse the wheelchair A, that individual fully depresses the latches 92, causing the latches 92 to push the offset ends 54 of the upper outriggers 40 upwardly in the slots 86 of the upper brackets 44. This, in effect, frees the offset ends 54 of the upper outriggers 40 from the upper brackets 44, so that the backrest 24 may be lifted upwardly. As this occurs, the offset ends 54 of the upper outriggers 40 come out of the vertical slots 86 in the upper bracket 44, whereas the offset ends 54 of the lower outriggers 42 come out of the vertical slots 86 in the lower brackets 46.

This invention is intended to cover all changes and modifications of the example of the invention herein chosen for purposes of the disclosure which do not constitute departures from the spirit and scope of the invention.

What is claimed is:

1. A backrest assembly for a chair for seating an individual, said chair having a seat and upright posts which are spaced apart generally behind the seat of the chair and rise above that seat, said backrest assembly comprising: a backrest adapted to be located generally between the spaced apart chair posts so as to provide a surface for positioning the back of an individual who sits upon the chair seat; a first positioning member having a cross portion mounted on the backrest and being rotatable about a generally horizontal axis, the first positioning member having portions which are offset from the axis of rotation; first connecting means adapted to be mounted on the posts for engaging the offset portions of the first positioning member; a second positioning member mounted on the backrest below the first positioning member, the second positioning member being rotatable about a second generally horizontal axis that is fixed with respect to the backrest and having portions which are offset from said second horizontal axis; and second connecting means adapted to be mounted on the posts for engaging offset portions of the second positioning member.

2. A backrest assembly according to claim 1 and further comprising clamps on the backrest for enabling the positioning members to rotate relative to the backrest when in a release condition and for preventing rotating of the first and second positioning members when in a clamping condition, whereby the positioning members may be rotated to a desired position and then secured against rotation.

3. A backrest assembly according to claim 2 wherein each positioning member is a rod containing a cross portion extended horizontally across the backrest, radially directed arms located beyond the backrest and having ends, and the offset portions are located at the ends of the arms where they are axially aligned with each other and are parallel to the cross portion.

4. A backrest assembly according to claim 3 wherein each clamp comprises inner and outer clamp elements having opposed grooves which receive the cross portion of one of the positioning members, and means for urging the outer clamping element toward the inner clamping element, and wherein the inner element is attached to the backrest.

5. A backrest assembly according to claim 4 wherein the means for urging the clamping element together are screws, there being one screw located above the grooves of the clamping elements and another located below the grooves.

6. A backrest according to claim 1 wherein the backrest bows forwardly between the first and second positioning members.

7. A backrest according to claim 1 wherein the second connecting means have slots which receive the offset portions of the positioning members.

8. A backrest according to claim 7 wherein the slots of the second connecting means have open ends, and the open ends are presented upwardly.

9. A backrest according to claim 8 wherein at least one of the connecting means has a releasable latch which prevents the offset portion that fits within the slot at that connecting means from being withdrawn upwardly unless released.

10. A backrest assembly according to claim 9 wherein all of the connecting means may be moved to different positions along the upright posts.

11. A backrest assembly according to claim 9 wherein each connecting means comprises a block adapted to be located along one of the upright posts and containing the upwardly opening slot for receiving one of the offset portions, a strap adapted to extend around the post, and means for drawing the strap back toward the block so as to urge the block tightly against the back post along which it is located.

12. The backrest assembly of claim 1 wherein the first and second positioning members are laterally adjustable to accommodate chairs of different widths.

13. The backrest assembly of claim 12 wherein the said positioning members each include a cross rod formed in two sections, a sleeve connecting said sections, and means to fix the locations of said rod sections with respect to said sleeves.

14. A backrest assembly for a chair having a seat and upright back posts located generally behind the seat, with the posts rising above the seat, said backrest assembly comprising: a backrest adapted to be located in a generally upright position generally between the back posts; clamps located on the backrest; upper and lower outriggers attached to the backrest at the clamps and being rotatable about horizontal axes when the clamps are released, each outrigger including a cross rod which extends horizontally across the backrest, generally radial arms connected to the cross rod, and offset ends connected to the arms and being radially offset from the cross rod, yet axially aligned with each other and parallel to the cross rod; and brackets adapted to be positioned on the back posts of the chair for receiving and retaining the offset ends of the outriggers so that the brackets support the backrest between the posts.

15. The backrest assembly of claim 14 including means for adjusting the length of the cross rods to compensate for chairs of different widths.

16. A backrest assembly according to claim 14 wherein each bracket has an upwardly opening slot which receives one of the offset ends of one of the outriggers.

17. A backrest assembly according to claim 16 wherein the brackets for the upper outrigger have latches which normally prevent the offset ends of that rod from being withdrawn from those brackets, the latches being movable to a release position to permit the offset ends to be withdrawn from the slots.

18. A backrest assembly according to claim 17 wherein the brackets include means for attaching them to the posts at selected locations along the posts, whereby the brackets are adapted to be adjustable upwardly and downwardly on the posts.

19. In combination with a wheelchair having a seat for supporting a user and upright backposts located generally behind and rising above the seat, a backrest assembly for supporting and positioning the back of the user when seated upon the seat, said backrest assembly comprising: upper and lower brackets attached to each of the posts; upper and lower outriggers extended between the upper and lower brackets, respectively, each outrigger including a positioning cross rod having ends, generally radially directed arms at the ends of the cross rods, and offset ends at the ends of the rods, with each end being engaged by one of the brackets; clamps gripping the cross rods of the outriggers, but being releasable from the cross rod so that the outriggers may rotate relative to the clamps; and a backrest attached to the clamps for the upper and lower outriggers and being located generally between the back posts, whereby the backrest is supported on the back posts such that it can be adjusted forwardly and backwardly and upwardly and downwardly, as well as angularly, with respect to the wheelchair seat.

20. The combination according to claim 19 wherein the backrest bows forwardly between the upper and lower positioning rods.

21. The combination according to claim 19 wherein the brackets are configured to enable the offset ends of the positioning rods to be removed from the brackets, so that the backrest may be removed from the wheelchair; and wherein at least one of the brackets contains a releasable latch for retaining said offset end in that bracket until the latch is released.

22. The combination according to claim 21 wherein the brackets are adjustable upwardly and downwardly on the backposts.

23. The combination of claim 22 wherein the cross rods are laterally adjustable to accommodate chairs of different widths.

24. The combination according to claim 19 wherein the offset ends of each outrigger lie parallel to the cross rod of the outrigger and are axially aligned.

25. The combination according to claim 24 wherein each bracket contains a slot into which the offset end of the outrigger fits.

26. A backrest assembly for a wheelchair for seating an individual which wheelchair has a seat and upright posts which are spaced apart generally behind the wheelchair seat and which project above that seat, said backrest assembly comprising (a) a backrest having a top and bottom and adapted to be located generally between the spaced apart posts to provide a surface for positioning in a predetermined fixed position the back of an individual who sits upon the seat, (b) first and second positioning means mounted on the backrest in vertically spaced relationship, said positioning means being rotatable about and independently lockable in fixed position with respect to a horizontal axis, (c) bracket means for connecting both the first and second positioning means to the chair upright posts, said bracket means being movable along and lockable to the said posts to position the backrest in a vertically fixed location along the upright posts, and (d) means associated with the positioning means and the bracket means for moving the top and bottom of the backrest forwardly, rearwardly and vertically with respect to the upright posts to adjustably position the individual fixedly in selected positions.

27. A backrest assembly for a wheelchair for seating an individual which wheelchair has a seat and upright posts which are spaced apart generally behind the wheelchair seat and which project above that seat, said backrest assembly comprising (a) a backrest having a top and bottom and adapted to be located generally between the spaced apart posts to provide a surface for positioning in a predetermined fixed position the back of an individual who sits upon the seat, (b) positioning means mounted on the backrest, said positioning means being laterally adjustable in length so that the backrest can accommodate chairs of different widths and being rotatable about and lockable in fixed position with respect to a horizontal axis, (c) bracket means for connecting the positioning means to the chair upright posts, said bracket means being movable along and lockable to the said posts to position the backrest in a vertically fixed location along the upright posts, and (d) means associated with the positioning means and the bracket means for moving the top and bottom of the backrest forwardly, rearwardly and vertically with respect to the upright posts to adjustably position the individual in selected positions.

28. A backrest assembly for a wheelchair for seating an individual which wheelchair has a seat and upright posts which are spaced apart generally behind the wheelchair seat and which project above that seat, said backrest assembly comprising (a) a backrest having a top and bottom and adapted to be located generally between the spaced apart posts to provide a surface for positioning in a predetermined fixed position the back of an individual who sits upon the seat, (b) positioning means mounted on the backrest, said positioning means being rotatable about and lockable in fixed position with respect to a horizontal axis, (c) bracket means for connecting the positioning means to the chair upright posts, said bracket means being movable along and lockable to the said posts to position the backrest in a vertically fixed location along the upright posts, and (d) means associated with the positioning means and the bracket means for moving the top and bottom of the backrest forwardly, rearwardly and vertically with respect to the upright posts to adjustably position the individual in selected positions, said means comprising offset ends on the positioning means, slots in the bracket means which receive the offset ends, and means for locking at least some of the offset ends in their respective slots, whereby rotation of the means associated with the positioning means and the bracket means moves the backrest inwardly and outwardly as well as upwardly and downwardly.

* * * * *